United States Patent [19]

Barber

[11] 4,075,546

[45] Feb. 21, 1978

[54] REGULATED POWER SUPPLY WITH COMBINED SERIES AND SHUNT REGULATING TRANSISTORS

[76] Inventor: Alfred William Barber, 50-16 232nd St., Bayside, N.Y. 11364

[21] Appl. No.: 715,397

[22] Filed: Aug. 18, 1976

[51] Int. Cl.[2] ..... G05F 1/56; G05F 1/60

[52] U.S. Cl. ..... 323/22 T; 323/40

[58] Field of Search ..... 323/8, 22 T, 40

[56] References Cited

U.S. PATENT DOCUMENTS

| | | | |
|---|---|---|---|
| 3,124,697 | 3/1964 | Trenchard | 323/22 T |
| 3,124,698 | 3/1964 | Semmer et al. | 323/22 T |
| 3,295,052 | 12/1966 | Martin | 323/22 T |
| 3,388,316 | 6/1968 | Gately | 323/40 |
| 3,659,189 | 4/1972 | Kiviranna | 323/40 |
| 3,678,370 | 7/1972 | Gately | 323/40 |

*Primary Examiner*—Gerald Goldberg

[57] ABSTRACT

Unipolar regulated power supplies can be provided with two way control of output voltage by a transistor of polarity opposite to that of the pass transistor connected in shunt with the load and driven from the same error amplifier as the one which drives the pass transistor.

3 Claims, 4 Drawing Figures

REGULATED POWER SUPPLY WITH COMBINED SERIES AND SHUNT REGULATING TRANSISTORS

PRIOR ART

A well known power supply regulator (see FIG. 1) utilizes a transistor connected in series between a source of unregulated DC voltage and a load to be supplied with regulated voltage. This regulated power supply is shown and described in U.S. Pat. No. 3,028,538. An error control voltage is generated in a bridge-like circuit having a source of reference voltage and a reference resistor as one branch, the load and a voltage control resistor as a second branch and the input to a control (error) amplifier as the third branch. The output of the control amplifier is connected to the control electrode of the series pass transistor. This basic circuit has been widely used for the past eighteen or so years and has proved to be a most useful and flexible circuit.

PROBLEM TO BE SOLVED

The basic bridge-like circuit briefly described above has a problem which becomes serious with certain types of load circuits under certain control conditions. While the basic bridge-like circuit is often represented with a fixed reference voltage, many applications have developed over the years in which the reference voltage is a variable voltage for programming a variable voltage to the load. For example, in automatic test systems the output voltage may be abruptly changed by means of an abrupt change in the reference voltage. When the reference is abruptly increased, the pass transistor passes an abrupt increase in current to the load to cause the load voltage to abrupty increase. When the reference voltage is abruptly decreased, the pass transistor passes an abruptly decreased current to the load to cause the load voltage to abruptly decrease. Now, however, if there is capacitance across the load either internally in the power supply or externally across the load the abrupt increases and decreases of voltage across the load which may be called for by the programmed reference voltage are modified. When abrupt increases in load voltage are called for by a reference voltage change, the rate of which the load voltage responds depends on the safe current which can be passed by the pass transistor which is generally set by a current limiting circuit. The response at the load the depends on the load capacitance, the rate of change called for by the reference voltage, the voltage change called for across the load and the maximum current which the pass transistor can safely supply. However, when an abrupt decrease in load voltage is called for a quite different situation pertains. First of all the pass transistor is a unidirectional device which can supply current to the load but cannot absorb it. So when a decrease in load voltage is called for, the pass transistor merely becomes a very high resistance passing no current and absorbing no current so that decay in the load voltage depends on the voltage across the load at the instant a decrease is called for, the capacitance across the load resistance. In other words the regulated power supply itself loses control of the load voltage.

THE PRESENT INVENTION

I have found that the above described problem with the conventional bridge-like regulated power supply can, be effectively solved by means of a second transistor of opposite polarity to the pass transistor, connected in shunt with the load and controlled from the same control (error) amplifier as is used to control the series pass transistor. This second transistor is driven into conduction by the reference voltage when it calls for a decrease in voltage across the load and thus discharging any capacitor across the load and providing a full dynamic control of the load voltage when taken in conjunction with the pass transistor. This mode is not to be confused with bipolar power supply operation since the mode described in accordance with this invention is strictly unipolar. It is, say, charge and discharge modes provided by a unipolar regulated power supply. What it does, in many cases, is to speed up the rate of programming which can be accomplished with a unipolar power supply.

Figure 1:
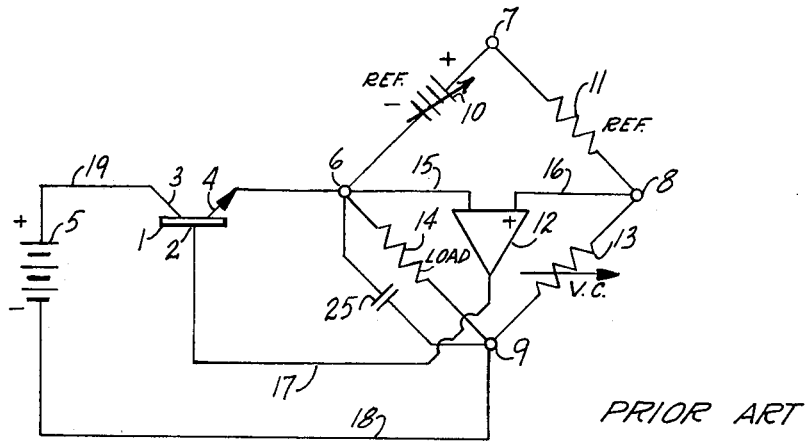
FIG. 1 is a simplified schematic cricuit diagram of a prior art regulated power supply to which the present invention may be applied.

FIG. 1 shows in a simplified schematic circuit diagram one prior art circuit to which the present invention may be applied to advantage. In this circuit a bridge like network providing three branches connected between terminals 6 and 8. One branch consists in a source of reference voltage 10 and a reference resistor 11, another branch consists in the load resistor 14 and a voltage control resistor 13; and the third branch consists in the input to the error amplifier 12 connected over leads 15 and 16. The output or load terminals are 6 and 9 and the load is shunted by capacitor 25 which may be considered either internal or external to the power supply or it may be the sum of an internal and an external capacitance. A source of unregulated voltage 5 is connected over lead 18 to load terminal 6 and over lead 19 to collector 3 of series pass transistor 1. Emitter 4 of pass transistor 1 is connected to load terminal 6 and base 2 is connected over lead 17 to the output terminal of error amplifier 12.

The operation of the circuit of FIG. 1 is described in the above referenced U.S. Patent and is well known in the regulated power supply art but will be briefly described below. Under steady regulating conditions, the voltage drop provided by the reference voltage between terminals 6 and 7 is equal and opposite to the voltage drop across reference resister 11 between terminals 7 and 8 so that the potential of terminal 8 is substantially the same as the potential of terminal 6. At the same time the voltage drop across load 14 between terminals 6 and 9 is equal and opposite to the voltage drop across voltage control resistor 13 between terminals 8 and 9 so that again terminal 8 is at the same potential as terminal 6. Thus there is a balance in the bridge-like circuit and a null across the input to amplifier 12. Now, if there is a change in the circuit as, for example, a change in the reference voltage 10, the load resistance or the voltage control resistor, the balance is upset and a potential appears at terminal differing from the potential on terminal 6 and consequently an error voltage appears across the input to error amplifier 12. This error voltage is amplified by amplifier 12 and the amplified voltage appearing at the output of amplifier 12 is applied over lead 17 to base 2 of series pass transistor 1. It is usual to consider terminal 6 the "common" terminal to the amplifier and terminal 8 the "high" or input terminal. With the circuit as shown, when terminal 8 is connected to the noninverting input of amplifier 12, the circuit acts automatically to restore the balance between terminals 8 and 6 bringing the circuit back to a stable condition. For example, if the load resistance is suddenly reduced, the voltage across it will drop but the regulating action of the circuit will cause the pass transistor to conduct more heavily supplying more current to the load to restore the original voltage. Changes in the reference voltage 10 or the value of the voltage control resistor 13 will unbalance the circuit calling for more or less conduction in the pass transistor to restore balance.

Figure 3:
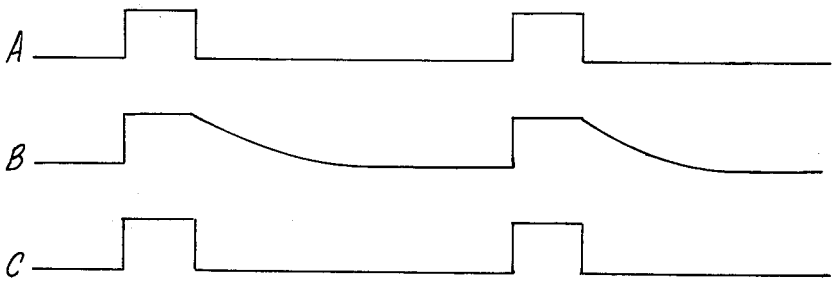
FIG. 3 is a set of graphical representations useful in explaining the invention.

It can be seen that with this circuit the control is unidirectional. That is, pass transistor can be controlled only to pass more or less current but it cannot sink or absorb current as by passing current in the reverse direction. When the current circuit suddenly calls for increased voltage across the load, the pass transistor is made to conduct more heavily supplying increased current to the load raising its voltage. However, when the circuit calls for decreased voltage across the load, while the pass transistor may be driven out of condition, it cannot thereby cause the load voltage to drop due to the presence of shunt capacitance 25. This action is illustrated in FIG. 3 by graphs A and B. Graph A shows how the reference voltage might be pulsed calling for a corresponding voltage pulse across the load resistor. Now, the pass transistor is able to cause the voltage across the load to increase sharply as shown in graph B, but if the capacitance across the load is substantial the decrease in voltage cannot be controlled by the pass transistor and will take the shape of voltage decay across a capacitor also shown in graph B.

Figure 2:
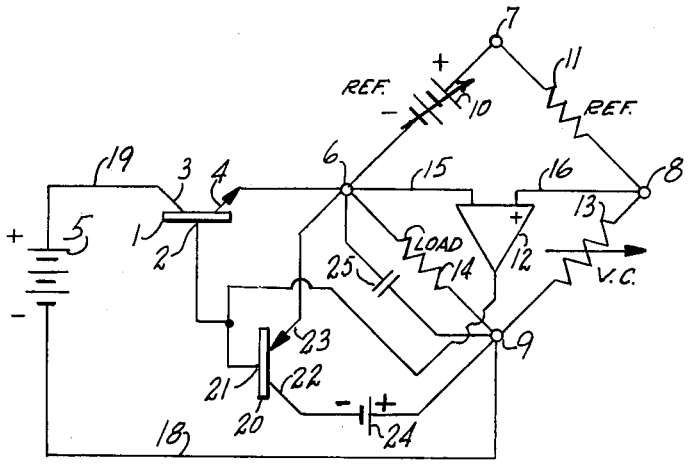
FIG. 2 is a simplified schematic circuit diagram of the preferred form of the present invention.

FIG. 2 is a simplified schematic circuit diagram of the present invention applied to the prior art circuit of FIG. 1. The portions of the circuit bearing the same numerals correspond with the parts of FIG. 1 and function in the same way. However, in FIG. 2 a second transistor 20 has been added connected across the output or load terminals 6 and 9. Emitter 23 is connected to common terminal 6, collector 22 is connected through a source of bias voltage 24 to output or load terminal 9 and base 21 is connected to the output of amplifier 12 i.e. the same point to which base 2 of pass transistor 1 is connected. It will be seen that the second transistor is of opposite polarity to the pass transistor. Thus, if the pass transistor is NPN, as shown, the second transistor will be PNP, as shown. By the same reasoning if the pass transistor is PNP the second transistor will be NPN.

Describing the functioning of the invention as shown in FIG. 2, the added or second transistor 20 functions in response to error voltages polled oppositely to those which cause the pass transistor to increase conductivity. The pass transistor 1 increases conductivity when increased voltage across the load is called for while the second or shunt transistor 20 increases in conductivity when a decrease in load voltage is called for by the circuit. In this way positive control is maintained for decreasing the load voltage as well as for increasing the load voltage thus overriding the effect of shunt capacitance across the load. The response of the total circuit becomes as shown in graph C of FIG. 3 in which the capacitance discharge effect of curve B is removed and positive control of load voltage is provided bidirectionally.

While the invention has been illustrated as applied to a bridge-like regulated power supply, it is equally applicable to other regulators of the unidirectional control type employing series pass transistors. Many regulated power supplies are designed to operate at a fixed output voltage in which case the auxiliary voltage source 24 as shown in FIG. 2 may be omitted.

Figure 4:
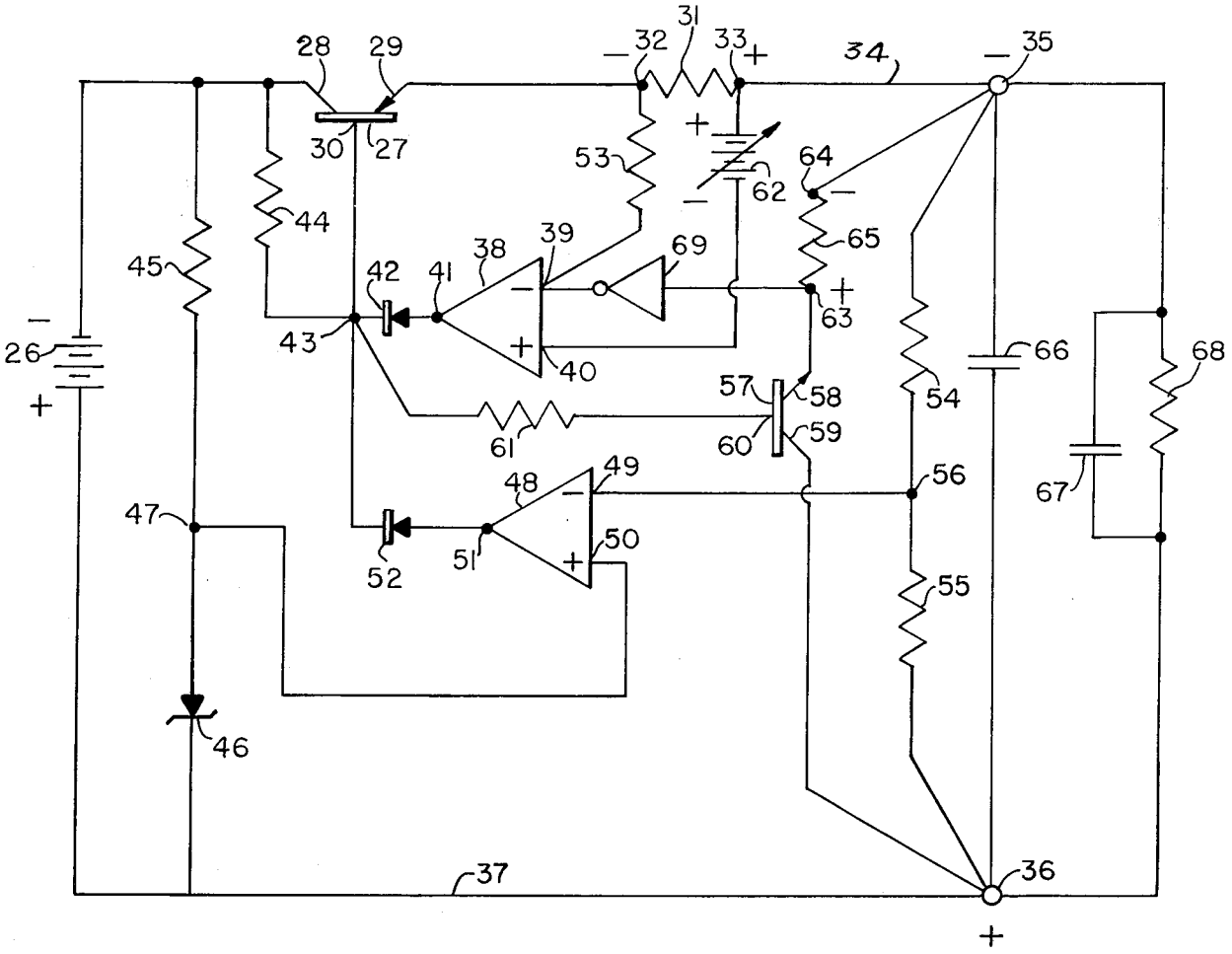
FIG. 4 is a simplified schematic circuit diagram of the preferred form of the invention incorporating current limiting provisions.

FIG. 4 shows how the present invention may be applied to a voltage comparison type of regulated circuit. In addition, current limiting of both polarities of control of output voltage is shown. A source of unregulated voltage represented by battery 26 is applied between common line 37 and collector 28 of series pass transistor 27. Emitter 29 is connected to a terminal 32 of current sensing resistor 31 the other terminal 33 of which is connected over line 34 to negative load terminal 35. Common line 37 is connected to positive load terminal 36. Regulation of the voltage across load terminals 35-36 is provided by comparing a portion of the voltage across the load terminals with a reference voltage. A voltage divider comprising resistors 54 and 55 joined at 56 and connected between negative terminal 35 and positive terminal 36. A reference voltage is provided by means of resistor 45 in series with zener diode 46 joined at 47 and connected across the unregulated voltage source 26. An error amplifier 48 having an inverting input terminal 49, a noninverting input terminal 50 and an output terminal 51 is used to control the pass transistor and in turn the voltage across the load terminals. Junction 56 is connected to input terminal 49; junction 47 is connected to input terminal 50; and an output terminal 51 is connected through gate diode 52 to junction point 43 which in turn is connected to base 30 of pass transistor 27. This circuit acts to maintain the potentials at junction points 56 and 47 equal and hence regulates the voltage across load terminals 35 and 36. A forward bias is applied to base 30 through resistor 44 and amplifier 48 provides a counteracting positive potential through diode 52 whenever the potential of junction point 56 tends to become more negative than the reference voltage at junction point 47.

Current limiting is provided by error amplifier 38 which compares the drop across current sensing resistor 31 with an adjustable source of reference voltage represented by adjustable battery 62. Error amplifier 38 includes inverting input terminal 39, non-inverting input terminal 40 and output terminal 41 which in turn is gated to junction point 43 by means of gate diode 42. Terminal 32 is connected to input terminal 39 through decoupling resistor 53 and reference voltage source 62 is connected between terminal 33 and input terminal 40. When the voltage drop across resistor 31 due to load current exceeds the voltage set on reference 62, output terminal 41 becomes positive and gate diode 42 conducts to drive base 30 in a positive direction thereby limiting the current through pass transistor 27 to a preset value.

The capacitance across load terminals 35 and 36 includes internal capacitance 66 and external capacitance 67. Load resistance is represented by resistor 68.

The circuit as described so far will provide regulated voltage across load terminals 35-36 and will act fast to correct any tendency for the load voltage to drop as, for example, a sudden decrease in the value of load resistance. The current available to provide this correction is limited by the current limiting circuit in order to protect the pass transistor.

However, should the load terminal voltage tend to increase suddenly as, for instance, due to a sudden increase in load resistance, the pass transistor may lose control due to the charge in capacitors 66 and 67. In other words, the circuit as described so far provides unipolar control of the terminal voltage. In order to provide bipolar control transistor 57 including emitter 58, collector 59 and base 60 is provided in shunt with the load terminals. It will be noted that this shunt transistor has a polarity opposite to that of the series pass transistor. Collector 59 is connected to positive load terminal 36; emitter 58 is connected through current sensing resistor 65, connected between terminals 63 and 64, to negative load terminal 35 and base 60 is connected to junction point 43 through resistor 61. With this provision, if amplifier 48 calls for less current from pass transistor 27 (positive going output on output terminal 51) and pass transistor 27 is unable to reduce the voltage across the load terminals fast enough due to capacitors 66 and 67, transistor 57 is turned on to dissipate the charge on these capacitors and pull the load terminal voltage down. If however, the current in pull down transistor 57 tends to go too high the drop across current sensing resistor 65 is fed back through unity gain inverting amplifier 69 to terminal 39 of current limiting control amplifier 38. The current through shunt transistor 57 is limited when the drop across current sensing resistor 65 exceeds the preset reference voltage 62 causing a positive output to appear at output terminal 41 which is applied to base 60 through diode 42 and resistor 61. In this way the current in both forward conducting transistor 27 and reverse conducting transistor 57 are limited to safe preset values.

Many modifications of the invention are possible as long as they come within the spirit and scope of the invention as set forth and defined in the appended claims.

I claim:

1. In a regulated power supply including a reference voltage source, a pair of load terminals, a capacitative load connected across said load terminals, means for controlling the voltage across said load terminals in accordance with said reference voltage consisting of; an error amplifier having input and output terminals connected with its input coupled to said source of reference voltage and said load terminals in order to provide an error voltage to said amplifier, a source of unregulated voltage and a series pass transistor of a given polarity connected between said source of unregulated voltage and one of said load terminals and coupled to the output of said error amplifier for controlling the current to said load terminals and the voltage thereacross; the improvement which includes;

a second transistor of opposite polarity to said pass transistor connected in shunt with said load terminals and with its base coupled to the output of said error amplifier;

whereby said pass transistor solely controls current passing from said unregulated supply to said load and said second transistor solely absorbs current from said load providing two way flow of current to and from said load capacitance.

2. A regulated power supply as set forth in claim 1, and wherein;

the emitters of both the pass transistor and said second transistor are connected to the same load terminal

3. A regulated power supply as set forth in claim 1 and including;

feedback means for limiting the current passed by the pass transistor;

and feedback means for limiting the current through said second transistor.

* * * * *